United States Patent [19]

Miyamoto

[11] 4,411,452

[45] Oct. 25, 1983

[54] PRESSURE-SENSITIVE RECORDING MATERIAL

[75] Inventor: Akio Miyamoto, Fujinomiya, Japan

[73] Assignee: Fuji Photo Film Co., Ltd., Kanagawa, Japan

[21] Appl. No.: 368,929

[22] Filed: Apr. 16, 1982

[30] Foreign Application Priority Data

Apr. 16, 1981 [JP] Japan ..... 56-57593

[51] Int. Cl.[3] ..... B41M 5/16; B41M 5/22

[52] U.S. Cl. ..... 282/27.5; 427/150; 428/320.6; 428/320.8; 428/409; 428/537; 428/914

[58] Field of Search ..... 282/27.5; 427/150, 151; 428/320.4, 320.6, 320.8, 537, 914, 409

[56] References Cited

U.S. PATENT DOCUMENTS

| | | | |
|---|---|---|---|
| 3,193,404 | 7/1965 | Davis | 427/288 |
| 3,278,327 | 10/1966 | Davis | 282/27.5 |
| 3,793,075 | 2/1974 | Maalouf | 282/27.5 |

*Primary Examiner*—Bruce H. Hess

*Attorney, Agent, or Firm*—Sughrue, Mion, Zinn, Macpeak and Seas

[57] ABSTRACT

A pressure-sensitive recording material is described comprising a base paper having a surface of pH of at least 6.0 and having coated thereon microcapsules containing a benzhydrylsulfone type color former solution.

8 Claims, No Drawings

PRESSURE-SENSITIVE RECORDING MATERIAL

FIELD OF THE INVENTION

This invention relates to a recording material and, more particularly, to a pressure-sensitive recording material which is improved to be resistant to stain of coated surface thereof, stain of cut section thereof, and coloration of base paper surface.

BACKGROUND OF THE INVENTION

It has long been known to obtain color images by contact reaction between an electron-donating or protonaccepting colorless organic compound (hereinafter referred to as a color former) and an electron-accepting or protondonating solid acid (hereinafter referred to as a color developer). Examples of specifically utilizing this phenomenon are pressure-sensitive copying (or recording) papers (for example, U.S. Pat. Nos. 2,505,470, 2,505,489, 2,550,471, 2,548,366, 2,712,507, 2,730,456, 2,730,457, 3,418,250, and 3,672,935), heat-sensitive recording papers (for example, Japanese Patent Publication Nos. 4160/68, 7600/68, 14039/70, U.S. Pat. No. 2,939,009, etc.), and so forth.

Further, a printing method is known which comprises supplying a color former-containing ink to a color developer-coated sheet to obtain colored images (German Patent OLS No. 1,939,962).

The color developer has the above-defined properties and the examples thereof include acid clay, phenol resins, aromatic carboxylic acid metal salts, etc.

As the color former, there have been used those which are usually colorless, which possess a partial skeleton of lactone, lactam, sultone, spyropyran, ester, or amide, and which undergo ring cleavage or splitting of said partial skeleton when contacted with a color developer.

Specifically, there are illustrated triarylmethane compounds such as crystal violet lactone, xanthene compounds such as rhodamine B anilinolactam, spyropyran compounds such as 3-methyl-spiro-dinaphthopyran, thiazine compounds such as benzoyl leucomethylene bulue, and leucoauramine compounds such as N-(o-chlorophenyl)leucoauramine.

However, colored products formed by the reaction between a color former of triarylmethane compound, xanthene compound, spiro compound, or the like and an acid clay have poor durability, and, when in contact with water or an organic solvent, undergo reduction in density of color or disappearance of color. Of organic solvents, polar solvents such as alcohols (e.g., ethanol, butanol, propylene glycol, glycerin, etc.), amines (e.g., monoethanolamine, triethanolamine, etc.), and esters and ethers (e.g., ethyl acetate, diethylene glycol, monomethyl ether, dioctyl phthalate, dibutyl phthalate, etc.) exert strong influences on colored products when the organic solvents are contacted, directly or as a vapor, with the colored products, resulting in reduction in color density or the total disappearance of color.

The inventors have formerly proposed to use benzhydrylsulfone type color formers so as to overcome the above-described defects. However, recording sheets having coated thereon microcapsules retaining this benzhydrylsulfone type color former have the defect that the coated surface becomes bluish or that a cut section thereof undergoes color staining.

Further, when this microcapsule-coated paper is used in a so-called spot-printing process, which comprises printing a color developer-containing ink onto portions where copying (or recording) is necessary, some colored products are formed on the base paper surface other than color developer-coated portions (hereinafter referred to as base paper coloration). Thus, elimination of these defects has been eagerly desired.

SUMMARY OF THE INVENTION

An object of the present invention is to provide a recording material which overcomes the above-described defects.

As a result of various investigations, it has now been found that the above-described object can be attained by coating microcapsules containing a benzhydrylsulfone type color former solution onto a base paper having a surface pH of at least 6.0, preferably a surface pH of 6.0 to 8.0.

DETAILED DESCRIPTION OF THE INVENTION

As the benzhydrylsulfone type color former to be used in the present invention, those compounds which are represented by formula (I) are preferable.

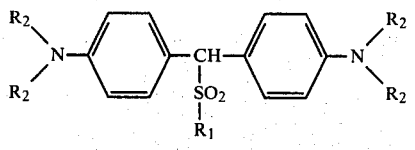

(I)

In formula (I), $R_1$ represents a monovalent group containing from 5 to 25 carbon atoms, and $R_2$ represents a lower alkyl group containing from about 1 to 5 carbon atoms.

In formula (I), the monovalent group represented by $R_1$ is preferably an alkyl group containing from 6 to 20 carbon atoms, a cycloalkyl group containing from 5 to 16 carbon atoms, an aralkyl group containing from 7 to 20 carbon atoms, an alkyl-substituted aryl group containing a total of from 11 to 25 carbon atoms, an acylamino-substituted aryl group containing a total of from 12 to 25 carbon atoms, an alkoxy-substituted aryl group containing a total of from 10 to 25 carbon atoms, an acyloxy-substituted aryl group containing a total of from 10 to 25 carbon atoms, an aryloxy-substituted aryl group containing a total of from 12 to 25 carbon atoms, or an aralkyl-substituted aryl group containing a total of from 13 to 25 carbon atoms, with an alkyl-substituted aryl group containing a total of from 14 to 25 carbon atoms or an alkoxy-substituted aryl group containing a total of from 12 to 25 carbon atoms being particularly preferable. As the lower alkyl group represented by $R_2$, an alkyl group containing from 1 to 5 carbon atoms is useful. A methyl group, an ethyl group, a propyl group and a butyl group are preferable, with a methyl group being particularly preferable. Benzhydrylsulfone compounds are disclosed in U.S. Pat. Nos. 3,193,404, 3,278,327, etc. However, the object of the present invention is attained only by combining the benzhydrylsulfone compounds with base paper having a surface pH of at least 6.0.

Specific examples of the compounds represented by formula (I) illustrated below:

(4,4'-Bis-dimethylamino)diphenylmethyl-n-octylsulfone;

(4,4'-Bis-dimethylamino)diphenylmethyl-n-dodecylsulfone;
(4,4'-Bis-dimethylamino)diphenylmethyl-n-hexadecylsulfone;
(4,4'-Bis-dimethylamino)diphenylmethyl-n-octadecylsulfone;
(4,4'-Bis-dimethylamino)diphenylmethyl-cyclohexylsulfone;
(4,4'-Bis-dimethylamino)diphenylmethyl-methylcyclohexylsulfone;
(4,4'-Bis-dimethylamino)diphenylmethyl-dimethylcyclohexylsulfone;
(4,4'-Bis-dimethylamino)diphenylmethyl-benzylsulfone;
(4,4'-Bis-dimethylamino)diphenylmethyl-2-phenethylsulfone;
(4,4'-Bis-dimethylamino)diphenylmethyl-3-phenylpropylsulfone;
(4,4'-Bis-dimethylamino)diphenylmethyl-α-methylbenzylsulfone;
(4,4'-Bis-dimethylamino)diphenylmethyl-p-octylbenzylsulfone;
(4,4'-Bis-dimethylamino)diphenylmethyl-p-dodecylbenzylsulfone;
(4,4'-Bis-dimethylamino)diphenylmethyl-n-amylphenylsulfone;
(4,4'-Bis-dimethylamino)diphenylmethyl-tert-amylphenylsulfone;
(4,4'-Bis-dimethylamino)diphenylmethyl-diisopropylphenylsulfone;
(4,4'-Bis-dimethylamino)diphenylmethyl-triisopropylphenylsulfone;
(4,4'-Bis-dimethylamino)diphenylmethyl-di-tert-butylphenylsulfone;
(4,4'-Bis-dimethylamino)diphenylmethyl-octylphenylsulfone;
(4,4'-Bis-dimethylamino)diphenylmethyl-nonylphenylsulfone;
(4,4'-Bis-dimethylamino)diphenylmethyl-dodecylphenylsulfone;
(4,4'-Bis-dimethylamino)diphenylmethyl-tetrahydronaphthylsulfone;
(4,4'-Bis-dimethylamino)diphenylmethyl-isopropylnaphthylsulfone;
(4,4'-Bis-dimethylamino)diphenylmethyl-diisopropylnaphthylsulfone;
(4,4'-Bis-dimethylamino)diphenylmethyl-cyclohexylphenylsulfone;
(4,4'-Bis-dimethylamino)diphenylmethyl-α-methylbenzylphenylsulfone;
(4,4'-Bis-dimethylamino)diphenylmethyl-diphenylmethylphenylsulfone;
(4,4'-Bis-dimethylamino)diphenylmethyl-benzylphenylsulfone;
(4,4'-Bis-dimethylamino)diphenylmethyl-phenoxyphenylsulfone;
(4,4'-Bis-dimethylamino)diphenylmethyl-octyloxyphenylsulfone;
(4,4'-Bis-dimethylamino)diphenylmethyl-dodecyloxyphenylsulfone;
(4,4'-Bis-dimethylamino)diphenylmethyl-octanoylaminophenylsulfone;
(4,4'-Bis-dimethylamino)diphenylmethyl-n-dodecylsulfone;
(4,4'-Bis-dibutylamino)diphenylmethyl-benzylsulfone;
(4,4'-Bis-dimethylamino)diphenylmethyl-dodecanoylaminophenylsulfone; and
(4,4'-Bis-dimethylamino)diphenylmethyl-dodecanoyloxyphenylsulfone.

These benzhydrylsulfone compounds can be used in combination with other color formers. In particular, when crystal violet lactone is used as the other color former in combination with these benzhydrylsulfone compounds of 10 to 200% by weight, preferably 50 to 100% by weight, based on the weight of crystal violet lactone, they provide colored products having improved durability and prevent base paper coloration, and thus such a combination is most preferable.

Examples of other color formers include triarylmethane compounds, xanthene compounds, spiro compounds, thiazine compounds, etc.

As a base paper on which a microcapsule dispersion is to be coated, rosin-sized papers can be used. Such rosin-sized papers contain alumina sulfate, and have a surface pH of from about 3 to 5.

In the present invention, so-called neutrally sized paper containing no alumina sulfate and having a surface pH of at least 6.0, preferably 6.0 to 8.0 is used. The surface pH can easily be measured by coating a pH indicator on a base paper. For example, a paper surface pH-testing solution made by Kyoritsu Rikagaku Kenkyusho K.K. can be utilized.

In the present invention, solvents for dissolving the benzhydrylsulfone type color formers include paraffin oil having a boiling point of 120° C. or more, chlorinated paraffin (chlorination degree: about 15% to 60%), and alkyl or aralkyl-benzene or naphthalene (alkyl moiety containing about 5 or less carbon atoms) such as triphenylmethane, diphenyltolylmethane, xylylphenylethane, benzylxylene, α-methylbenzyltoluene, diisopropylnaphthalene, isobutylbiphenyl, tetrahydronaphthalene, hydrogenated terphenyl, di-α-methylbenzylxylene, tert-butyl-diphenyl ether, styrene, dimer, etc.

Microcapsules to be used in the present invention can be prepared, for example, by a process utilizing coacervation as described in U.S. Pat. Nos. 2,800,457 and 2,800,458, a process of interfacial polymerization as described in British Pat. No. 990,443 and U.S. Pat. No. 3,287,154, a process of polymer precipitation as described in U.S. Pat. Nos. 3,418,250 and 3,660,304 and Japanese Patent Publication No. 23165/72, and a process of reactant polymerization from inside the oil droplets as described in U.S. Pat. Nos. 3,726,804 and 3,796,669. In particular, a process for forming a capsule wall on the outside surface of the oil droplets is advantageous from the viewpoint of forming highly concentrated fine oil droplets.

The color former is used in an amount of from about 0.03 to 0.5 g/m$^2$, and the color developer in an amount of from about 0.1 to 2 g/m$^2$.

In the present invention, particularly remarkable effects can be obtained by using acid clay and clay minerals such as bentonite and kaolin as the color developer. However, other color developers can be used. Examples of other developers include phenol resins, aromatic carboxylic acid polyvalent metal salts, etc.

The present invention will now be described in more detail by reference to examples of preferable embodiments of the present invention which, however, are not to be construed as limiting the present invention.

EXAMPLES

Preparation of Color Former Sheet 10 parts of acid-processed gelatin having an isoelectric point of 8.0 and 10 parts of gum arabic were dissolved in 60 parts of 40° C. water, and 0.2 part of sodium alkylbenzenesulfonate was added thereto as an emulsifier, followed by adding thereto 50 parts of a 3.5% solvent solution of a color former as indicated in Table 1. Then, the resulting mixture solution was stirred to effect emulsification thereof.

Additionally, the solvent used was a mixture of diisopropylnaphthalene and a petroleum fraction boiling at from 140° C. to 160° C. (3:2 by volume).

When the average size of the emulsified oil droplets became 8 microns, 100 parts of a 40° C. water was added thereto to stop the progress of emulsification.

While continuing the stirring, 210 parts of a 30° C. water was added thereto, and 20% hydrochloric acid was added thereto to adjust the pH of the system to 4.4. The solution was further cooled to 8° C. while stirring, and then 1.5 parts of 20% glutaraldehyde was added thereto.

Subsequently, 30 parts of a 10% carboxymethyl starch solution was poured thereinto, and 25% sodium hydroxide was dropwise added thereto to adjust the pH to 8.5. Then, the solution temperature was raised to 30° C. to obtain microcapsules having hardened wall.

10 parts of cellulose flock was dispersed therein, followed by coating the resulting solution on a base paper as indicated in Table 1 below.

Preparation of Base Paper 40 g/m$^2$ of base paper A having a surface pH of 6.5 was obtained under a Nagatsuna paper machine with LBKP:NBKP=8:2 and freeness of 45 SR by adding 0.2% of Aquopale 360 (alkylketene dimer; made by Hercules Company) and 2.0% positive starch.

In the same manner as described above except for further adding 5% calcium carbonate (precipitated calcium carbonate PC: made by Shiraishi Karushiumu K.K.) upon the making of the paper A, there was prepared a 40 g/m$^2$ of base paper B having a surface pH of 7.2.

Further, for comparison, 40 g/m$^2$ of a base paper C having a surface pH of 3.2 was prepared by adding 1.0 wt% of rosin and 2.0 wt% of alumina sulfate in place of Aquopale 360 and positive starch.

Additionally, the paper surface pH was measured by using a paper surface pH-testing solution made by Kyoritsu Rikagaku Kenkyusho K.K. (Kyoritsu Physical and Chemical Research Institute).

Testing Method

Two color former-containing capsule sheets were superposed on each other, and a pressure of 300 kg/cm$^2$ was applied thereto from the base paper side. The colorlation reflection density of the base paper was measured using a color analyzer Model 307 made by Hitachi Ltd.

Also, the stain density of the capsule-coated surface was similarly measured.

Further, 20 sheets of capsule-coated paper were superposed on each other, and subjected to guillotine cutting to compare color staining of the cut section. The color staining of the cut section was determined by visual observation.

Additionally, the density was measured as a reflection density for 617 nm light.

TABLE 1

| | Color Former Used | Coated Base Paper | Colorration of Base Paper | Color Stain of Capsule-coated Surface | Color Stain of Cut Section |
|---|---|---|---|---|---|
| Example 1 | (4,4'-Bis-dimethylamino)-diphenylmethyl-p-dodecyl-benzenedisulfone | Base Paper A (pH 6.5) | 0.07 | 0.042 | almost no coloration |
| Example 2 | (4,4'-Bis-dimethylamino)-diphenylmethyl-dodecyl oxyphenylsulfone | Base Paper B (pH 7.2) | 0.07 | 0.041 | almost no coloration |
| Example 3 | a mixture (3:1 by wt.) of (4,4'-bis-dimethylamino)di-phenylmethyl-diisopropyl-naphthylsulfone and crystal violet lactone | Base Paper B (pH 7.2) | 0.06 | 0.040 | almost no coloration |
| Comparative Example 1 | same as in Example 1 | Base Paper C (pH 3.2) | 0.22 | 0.068 | serious coloration |

In Table 1, a base paper coloration density of 0.08 or less is a level considered as imposing no problems. Thus, conventional defects can be overcome by using the benzhydrylsulfone type color former and a neutrally sized base paper having a surface pH of at least 6.0

Also, problems of color stain of capsule-coated surface and color stain of cut section can be solved by the use of neutrally sized base paper having a surface pH of at least 6.0.

On the other hand, these capsule-coated sheets show excellent color-forming characteristics when superposed on color-developing sheets to form colors thereon. Thus, the recording materials of the present invention clearly have excellent properties.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording material comprising a base paper having a surface pH of at least 6.0 and having coated thereon microcapsules containing a benzhydrylsulfone type color former solution, wherein the benzhydrylsulfone type color former is represented by the formula (I)

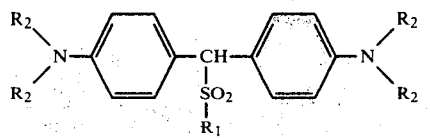

(I)

wherein $R_1$ represents a monovalent group containing from 5 to 25 carbon atoms and $R_2$ represents a lower alkyl group containing from about 1 to 5 carbon atoms.

2. A pressure-sensitive recording material as in claim 2, wherein the monovalent group represented by $R_1$ is an alkyl group containing from 6 to 20 carbon atoms, a cycloalkyl group containing from 5 to 16 carbon atoms, and aralkyl group containing from 7 to 20 carbon atoms, an alkyl-substituted aryl group containing a total of from 11 to 25 carbon atoms, an acylamino-substituted aryl group containing a total of from 12 to 25 carbon atoms, an alkoxy-substituted aryl group containing a total of from 10 to 25 carbon atoms, an acyloxy-substituted aryl group containing a total of from 10 to 25 carbon atoms, an aryloxy-substituted aryl group containing a total of from 12 to 25 carbon atoms, or an aralkyl-substituted aryl group containing a total of from 13 to 25 carbon atoms.

3. A pressure-sensitive recording material as in claim 3, wherein $R_1$ is an alkyl-substituted aryl group containing a total of from 14 to 25 carbon atoms or an alkoxy-substituted aryl group containing a total of from 12 to 25 carbon atoms.

4. A pressure-sensitive recording material as in claim 1, wherein the lower alkyl group represented by $R_2$ is a methyl group, an ethyl group, a propyl group and a butyl group.

5. A pressure-sensitive recording material as in claim 1, wherein the microcapsules additionally contain crystal violet lactone.

6. A pressure-sensitive recording material as in claim 1, 2, 3, 4, or 5, wherein the color former is present in an amount of from 0.03 to 0.5 $g/m^2$.

7. A pressure-sensitive recording material as in claim 6, wherein a color developer is present in an amount of from about 0.1 to 2 $g/m^2$.

8. A pressure-sensitive recording material as in claim 1, wherein the surface pH is 6.0 to 8.0.

* * * * *